United States Patent [19]

Davidson

[11] 4,197,063

[45] Apr. 8, 1980

[54] SPINNING FIBRES

[75] Inventor: John F. Davidson, Cambridge, England

[73] Assignee: Imperial Chemical Industries Limited, London, England

[21] Appl. No.: 929,184

[22] Filed: Jul. 28, 1978

[30] Foreign Application Priority Data

Jul. 29, 1977 [GB] United Kingdom ..... 32005/77

[51] Int. Cl.[2] ..... B29C 23/00

[52] U.S. Cl. ..... 425/8; 65/6; 65/14; 65/15; 264/8; 425/7

[58] Field of Search ..... 264/8, 7; 425/6, 7, 425/8; 159/3; 65/6, 8, 14, 15

[56] References Cited

U.S. PATENT DOCUMENTS

| | | | |
|---|---|---|---|
| 687,524 | 11/1901 | Fellner | 425/6 |
| 1,294,909 | 2/1919 | Howell | 264/8 |
| 2,587,710 | 3/1952 | Downey | 425/6 |
| 3,255,282 | 6/1966 | Shaffer et al. | 264/8 |
| 3,400,189 | 9/1968 | Wacke | 264/8 |
| 3,457,047 | 7/1969 | Tokimatsu et al. | 366/162 |
| 3,649,234 | 3/1972 | Charpentrev | 264/8 |
| 3,775,076 | 11/1973 | Pallo | 264/8 |
| 3,920,362 | 11/1975 | Bradt | 425/7 |

FOREIGN PATENT DOCUMENTS

| | | | |
|---|---|---|---|
| 1199431 | 8/1965 | Fed. Rep. of Germany | 264/8 |
| 1270679 | 4/1972 | United Kingdom | 264/8 |
| 1484492 | 9/1977 | United Kingdom | 264/8 |

OTHER PUBLICATIONS

"Filming of Liquids by Spinning Cups," Fraser et al., Chem. Eng. Sci., vol. 18, pp. 323–337, 1963, Pergamon Press.

*Primary Examiner*—Jay H. Woo

*Attorney, Agent, or Firm*—Cushman, Darby & Cushman

[57] ABSTRACT

A method of spinning fibres from a liquid, particularly a liquid urea formaldehyde resin, which comprises the step of supplying the liquid to at least one rotating annular reservoir having an outwardly extending upper and/or lower weir, and causing the liquid to flow outwardly over the said weir(s) and to be spun outwardly therefrom in the form of fibres by centrifugal force.

8 Claims, 5 Drawing Figures

Air
15b
15c
15d
15e
15a
ω
ω
10
8
7
4
6
16
12
2

SPINNING FIBRES

The present invention relates to a method and apparatus for spinning fibres. The invention is particularly, though not exclusively, applicable to spinning fibres from:

(a) solutions or dispersions of thermoplastics or other fibre-forming materials in aqueous or non-aqueous media, for example dispersions of PVA or PVC, solutions of polyethylene in xylene, etc. In this case, the fibres may be spun from liquid films which may be at room temperature, and stabilisation of the spun fibres may be effected by evaporation of the solvent or dispersant under the influence of an air stream which may be at a higher temperature;

(b) thermosetting resins, e.g. polyester resins, amino or phenolic resins in aqueous solution, epoxy resins, polyurethanes etc. In this case the resin may be caused to flow at low temperatures and stabilisation of the spun fibres may be effected by evaporation of solvent (e.g. in the case of amino resins) using an air stream at high temperatures; alternatively, stabilisation of the spun fibres may be effected wholly or partially by gelation of the resin (possibly using an elevated air temperature). Curing of the fibres may be completed outside the spinning apparatus.

(c) thermoplastic melts, for example polyethylene, polypropylene, polystyrene, etc., also glass and molten ceramics. In this case the conditions are reversed in comparison with cases (a) and (b), in that the melt is fed, while hot, to the spinning apparatus and the spun fibres are stabilised by cooling, a cool air stream being used for this purpose.

(d) suitably prepared inorganic salt solutions (e.g. of alumina, thoria, etc.). In this case, the solutions may be stabilised to form fibres by evaporation of the solvent, and subsequently heat-treated to give stable inorganic fibres. The air stream may be of controlled humidity to facilitate control of the drying of aqueous materials. Air may be replaced by another gas which may either be inert (e.g. nitrogen, carbon dioxide) or selected to react with the fibres during stabilisation or to catalyse a reaction within the fibres.

The polymeric or other fibre-forming material may conveniently, at the time of spinning, have a viscosity within the range 1 to 200 poise (preferably within the range 5 to 100 poise). For some materials, spinning aids (for example, solutions of high molecular weight linear polymers) may be used to stabilise the spun fibres.

The method and apparatus of the present invention is particularly useful in that makes it possible to control, to a high degree, the production of spun fibres.

The present invention provides a method of spinning fibres from a liquid, which comprises the step of supplying the liquid to at least one rotating annular reservoir having an outwardly extending upper and/or lower surface, and causing the liquid to flow outwardly over the said surface(s) and to be spun outwardly therefrom in the form of fibres by centrifugal force. The (or each) annular reservoir is conveniently coaxially mounted upon and rotates with a hollow, vertical, rotating liquid supply pipe which is co-axially mounted upon a rotatable drive shaft and which is connected to the reservoir by one or more hollow horizontal radial branch pipes, the liquid to be spun being supplied to the rotating reservoir through said supply pipe and branch pipe(s). Alternatively, the branch pipes may be replaced by a rotatable annular liquid feed plate co-axially mounted upon the drive shaft and which slopes downwardly and outwardly towards the annular reservoir to which it is secured at one or more points around its circumference. The liquid to be spun is supplied to the surface of the annular plate by a liquid supply pipe and flows downwardly and outwardly towards the annular reservoir. The outwardly extending surfaces of the reservoir are preferably in the form of weirs provided at the top and bottom of the reservoir.

The invention also provides an apparatus for spinning fibres from a liquid, comprising at least one rotatable annular reservoir having an outwardly extending upper and/or lower surface and means for supplying the liquid to be spun to the reservoir while the latter is rotating. Conveniently, the liquid-supplying means comprises a vertical hollow rotatable liquid supply pipe coaxially located within the annular reservoir, the annular reservoir being mounted upon and rotatable with the pipe, and liquid-transporting means connecting the interior of the supply pipe with the interior of the annular reservoir. Such liquid-transporting means may comprise at least one radial branch pipe connecting the interior of the supply pipe with the interior of the annular reservoir. As indicated above, the branch pipes may be replaced by a rotatable annular plate which is rotatably aand co-axially mounted upon the drive shaft and which slopes downwardly and outwardly towards the annular reservoir to which it is connected at one or more points around its circumference.The liquid to be spun is supplied to the surface of the annular plate by a liquid supply pipe, and flows downwardly and outwardly towards the annular reservoir. The outwardly extending surfaces of the reservoir are preferably in the form of weirs provided at the top and bottom of the reservoir.

One embodiment of the invention is hereinafter described with reference to the accompanying drawings wherein.

Figure 1:
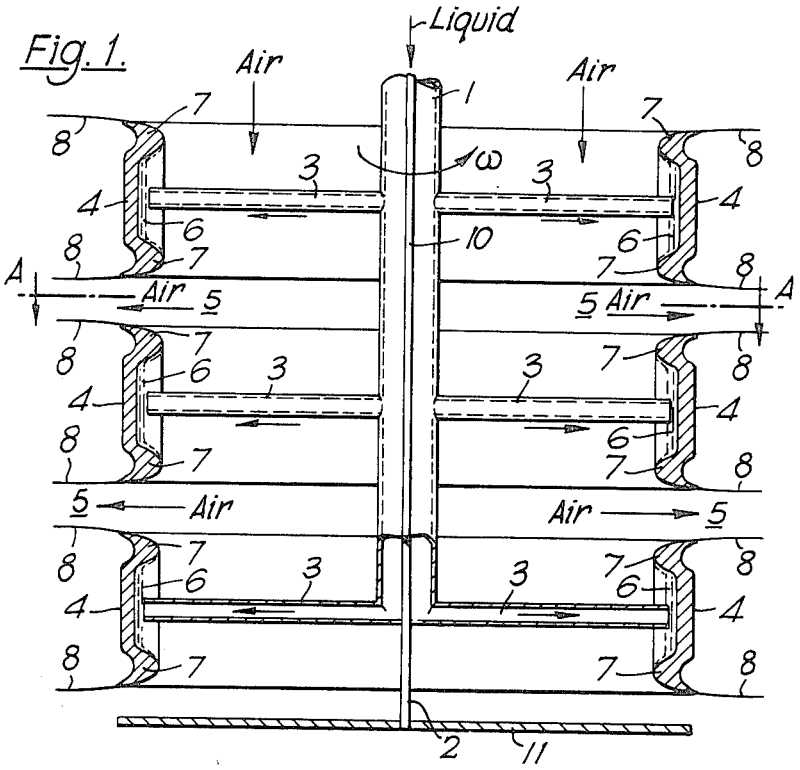
FIG. 1 is a cross-sectional view of an apparatus according to the invention along the line X—X of FIG. 2.
Figure 2:
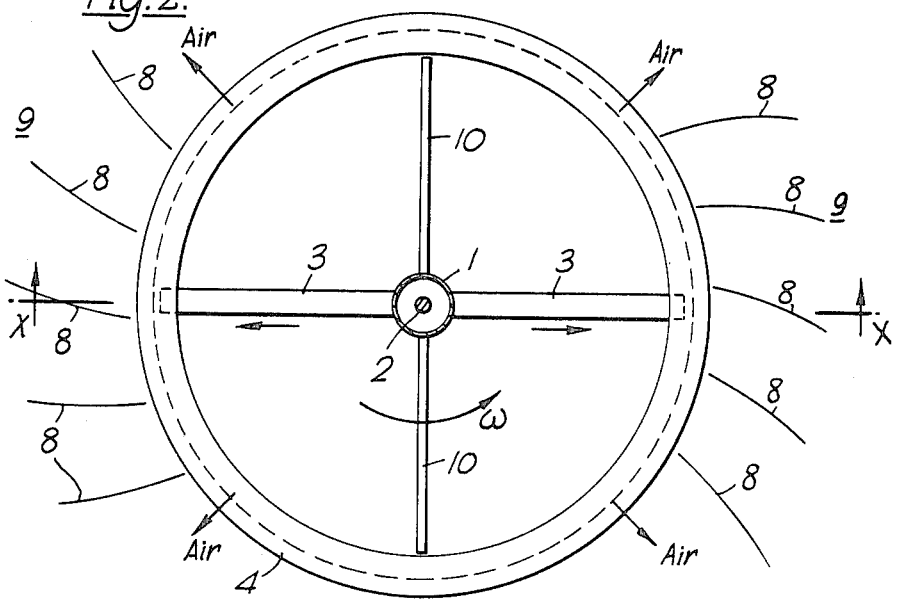
FIG. 2 is a plan view of the apparatus, along the line A—A of FIG. 1.

The apparatus of FIGS. 1 and 2 comprises a hollow supply pipe 1 for the liquid to be spun, mounted upon a drive shaft 2 which is rotatable as shown by the arrow $\omega$. The pipe 1 is provided with a plurality of hollow, radial branch liquid supply pipes 3. Mounted on the pipe 1, at the ends of the branch pipes 3, are a plurality of annular chambers, for example in the form of cylinders 4 which rotate, along with the supply pipe 1 and the branch pipes 2, as indicated by the arrow $\omega$. The annular chambers 4 are mounted substantially directly above one another, with a gap 5 therebetween. Each annular chamber 4 includes a reservoir 6 for the liquid to be spun, and upper and lower weirs 7.

The fibres are formed from thin liquid films flowing over the weirs 7 from the reservoirs 6 under centrifugal action due to the rotation $\omega$. The liquid forms a continuous film while in contact with the weirs but the film breaks up into filaments 8 on leaving each weir 7.

The reservoirs 6 are fed with the liquid to be spun through a supply pipe 1 which feeds a number of branch supply pipes 3. In each branch pipe 3 there is radial flow of the liquid and the liquid is then spread round the reservoir 6 by the centrifugal action due to the rotation $\omega$. There may need to be more than one branch pipe 3 per reservoir; two are shown in the drawings, but more may be needed to get even distribution of the liquid round the periphery of each reservoir 6.

Air or other gas is supplied so as to flow radially through the gaps 5 between successive weirs 7. The air flows out radially with the fibres 8. Adjustment of the air flow and of the gap 5 is made to give the appropriate relative motion between air and fibres set solid at a radius 9 (FIG. 2) where they have the desired diameter.

The air may be blown in by a separate blower (not shown) at the top of the apparatus. The motion of the air is controlled by radial vanes 10 which are positioned along the whole height of the apparatus and which produce a pumping effect as they rotate with the drive shaft. These vanes ensure that the air rotates at the same angular velocity $\omega$ while the air is in the apparatus. The vanes may also, by suitable design of the entry at the top, induce an adequate flow of air without the need for a separate blower.

FIGS. 1 and 2 of the drawings show a three-chamber unit (each chamber marked 4) with three reservoirs 6; there may be many such reservoirs all mounted co-axially like the three shown. The apparatus terminates, at the bottom, with a plate 11. At the top, there are bearings (not shown) to support the supply pipe 1. The chambers 4 containing the reservoirs 6 are supported by spiders (not shown) mounted off the vanes 10 or off the branch supply pipes 3.

Figure 3:
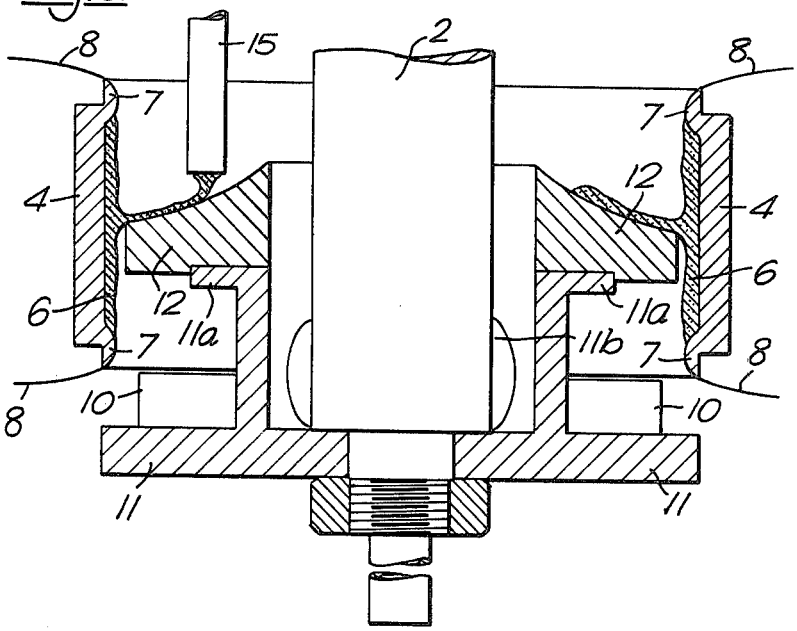
FIG. 3 is a cross-sectional view of another embodiment of the apparatus according to the invention.
Figure 4:
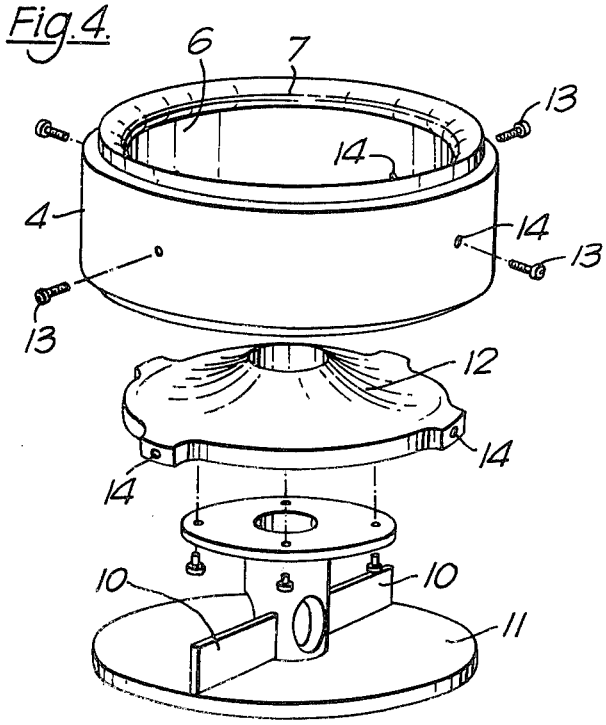
FIG. 4 is an exploded perspective view of part of the apparatus shown in FIG. 3.

In contrast, FIGS. 3 and 4 of the drawings show a single chamber unit (the chamber being marked 4) with a single reservoir 6. In this embodiment, the branch pipes are replaced by an annular liquid feed plate 12 which is rotatably and co-axially mounted on the drive shaft 2 and connected, at one or more points around its circumference, to the reservoir 6, for example by means of screws, bolts or the like 13 and suitably corresponding holes 14. The surface of the annular liquid feed plate slopes downwardly and outwardly from the drive shaft 2 towards the reservoir 6. In this case, the liquid to be spun is supplied to the surface of the rotating annular plate 12 by means of one or more stationary supply pipes 15.

The bottom plate 11 is bobbin-shaped and its lower flange is used to mount the chamber unit upon the drive shaft 2; its upper flange 11*a* is used to locate and support annular liquid feed plate 12. The annular liquid feed plate 12 is also used as a spider to support the spinning chamber 4 to which it is connected as described above.

In practice, a liquid (e.g. a liquid resin such as urea formaldehyde) is fed to the plate 12 through the pipe 15. The liquid spreads over and down the sloping surface of the plate 12 towards its outer rim. The liquid leaves the outer rim of the plate 12 and flows into the liquid reservoir 6, at approximately the mid-point of the latter. From the reservoir 6, the liquid flows over the weirs 7 and is spun centrifugally outwards therefrom in the form of fibres 8. Cooling air is able to pass down the annular space between the drive shaft 2 and the combined assembly of 11, 11*a* and 12, and then pass to the vanes 10, via large holes provided in the hub 11*b* of the bottom plate 11, which gives rise to a pumping effect as the vanes rotate with the drive shaft.

Figure 5:
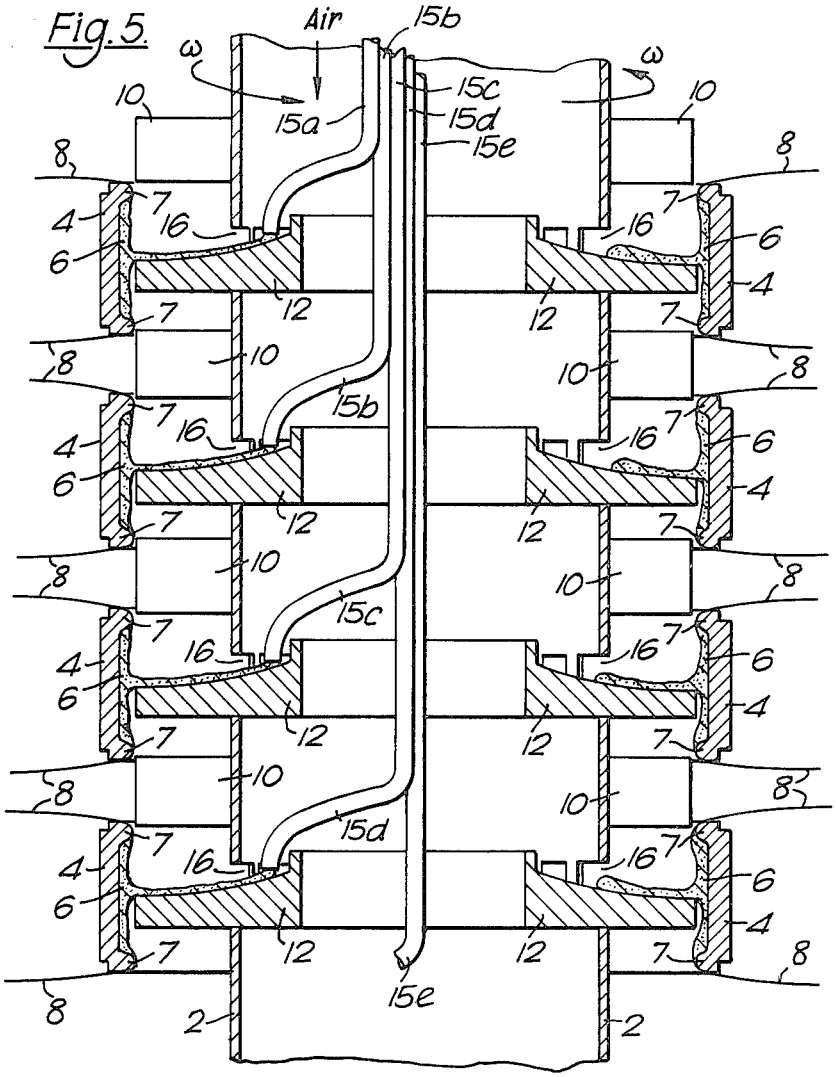
FIG. 5 illustrates an alternative embodiment of the apparatus according to the invention.

In contrast to FIGS. 3 and 4 of the drawings, FIG. 5 illustrates four chamber units (the chambers being marked 4) mounted one above the other. Each of the chamber units is similar to that shown in FIGS. 3 and 4 except that, since there are four chamber units and four annular plates 12, there must be four liquid supply pipes, 15*a*, 15*b*, 15*c* and 15*d*, one for each of the plates 12. (A fifth pipe 15*e* is shown merely to illustrate what the arrangement would be like if there were a fifth chamber unit below the four already illustrated). In this embodiment, the drive shaft 2 is hollow and of sufficient diameter to contain all the supply feed pipes 15*a* to 15*e*, including the bottom ends thereof which deposit the liquid on to the annular liquid feed plates 12. The latter are welded or otherwise secured to the drive shaft 2, so that they rotate with it. Apertures 16 are provided in the wall of the drive shaft 2, in order to allow the liquid fed to the annular feed plates from the bottom ends of the liquid supply pipes, 15*a*, to 15*e*, to flow outwardly and downwardly into the reservoirs 6.

In one experiment, "Aerolite 300" (Registered Trade Mark) urea formaldehyde resin, supplied by Ciba-Geigy, was spun into fibres at a rate of about 78 g/min. using the apparatus shown in FIGS. 3 and 4. ("Aerolite 300" is an aqueous UF resin prepared by condensing a mixture of urea and formaldehyde in a F:U molar ratio of about 1.95:1, followed by concentration to a solids content of about 65% by weight. It has a viscosity, depending upon its age, of about 40 to 200 poise at room temperature, and a water tolerance of about 180%). The viscosity of the aqueous resin was adjusted to about 35 poise, and 10% by weight of a solution of a spinning aid and a catalyst were mixed with the aqueous resin immediately prior to its deposition on the annular liquid feed plate 12. The composition of the added solution was:

6.7% by weight ammonium sulphate
1.6% by weight polyethylene oxide (mol. wt. 600,00)
91.7% by weight water The drive shaft was spun at about 3500 rpm, and the fibres were dried by spinning them into an atmosphere heated to about 65°–69° C. The fibres were finally cured by heating to 120° C. for 3 hours.

I claim:

1. Apparatus for spinning fibres from a fibre-forming liquid comprising
   - at least one rotatable annular reservoir formed by a hollow open ended cylindrical member having an interior surface and having at each of said open ends an outwardly extending surface;
   - means for rotating the cylindrical member about its longitudinal axis; and
   - means for supplying the fibre-forming liquid to the interior surface of the cylindrical member while the latter is rotating.

2. Apparatus according to claim 1 wherein said cylindrical member is provided with an inwardly extending surface forming a weir between the liquid supply means and each outwardly extending surface.

3. Apparatus according to claim 1 wherein said at least one rotatable cylindrical member comprises a plurality of cylindrical members mounted on a common longitudinal axis.

4. Apparatus according to claim 1 wherein said at least one hollow cylindrical member is mounted on a vertical drive shaft.

5. Apparatus according to claim 4 wherein said at least one cylindrical member is coaxially mounted on a substantially vertical rotating liquid supply pipe having at least one radial branch pipe for each cylindrical member.

6. Apparatus according to claim 4 wherein the liquid supply means for each cylindrical member comprises a rotating annular feed plate coaxially mounted on the drive shaft and disposed within said cylindrical member and means for supplying the liquid onto the upper surface of the feed plate.

7. Apparatus according to claim 6 wherein the drive shaft is hollow and a stationary substantially vertical liquid supply pipe located within the hollow drive shaft is provided for said feed plate to supply liquid to the upper surface of the feed plate through apertures in the wall of the drive shaft.

8. Apparatus according to claim 6 wherein the means for supplying the liquid onto the upper surface of the feed plate comprises a substantially vertical liquid supply pipe located between the drive shaft and the cylindrical member.

* * * * *